US010780550B2

(12) United States Patent
Cibilich

(10) Patent No.: US 10,780,550 B2
(45) Date of Patent: Sep. 22, 2020

(54) SYSTEM FOR BLAST-CLEANING A BARGE DECK, SIDES, AND FITTINGS

(71) Applicant: Anthony Cibilich, Belle Chasse, LA (US)

(72) Inventor: Anthony Cibilich, Belle Chasse, LA (US)

( * ) Notice: Subject to any disclaimer, the term of this patent is extended or adjusted under 35 U.S.C. 154(b) by 290 days.

(21) Appl. No.: 15/914,734

(22) Filed: Mar. 7, 2018

(65) Prior Publication Data

US 2019/0210189 A1 Jul. 11, 2019

Related U.S. Application Data

(63) Continuation-in-part of application No. 15/867,862, filed on Jan. 11, 2018, now abandoned.

(51) Int. Cl.

| | |
|---|---|
| ***B24C 3/06*** | (2006.01) |
| ***B63B 59/06*** | (2006.01) |
| ***B24C 9/00*** | (2006.01) |
| ***B24C 3/10*** | (2006.01) |

(52) U.S. Cl.

CPC ..... *B24C 3/06* (2013.01); *B24C 3/062* (2013.01); *B24C 3/10* (2013.01); *B24C 9/00* (2013.01); *B63B 59/06* (2013.01)

(58) Field of Classification Search

CPC .. B24C 3/06; B24C 3/062; B24C 3/10; B24C 9/00; B63B 59/06

See application file for complete search history.

(56) References Cited

U.S. PATENT DOCUMENTS

| | | | | |
|---|---|---|---|---|
| 4,286,417 | A * | 9/1981 | Shelton | B24C 3/062 451/2 |
| 5,085,161 | A | 2/1992 | Cuneo et al. | |
| 5,211,125 | A | 5/1993 | Garland et al. | |
| 5,353,729 | A | 10/1994 | Goldbach et al. | |
| 5,355,823 | A | 10/1994 | Goldbach et al. | |
| 5,398,632 | A | 5/1995 | Goldbach et al. | |
| 6,102,157 | A | 8/2000 | Goldbach et al. | |
| 6,365,221 | B1 * | 4/2002 | Morton | B05B 13/005 427/140 |
| 7,823,523 | B2 | 11/2010 | Perez | |
| 7,934,467 | B2 | 5/2011 | Morton | |

(Continued)

FOREIGN PATENT DOCUMENTS

EP 0165911 B1 12/1990

*Primary Examiner* — Dung Van Nguyen

(74) *Attorney, Agent, or Firm* — Keaty Law Firm LLC

(57) ABSTRACT

A system for blast-cleaning a barge deck, sides, and fittings providing for safety and avoidance of damage to the barge and to persons, where a barge is blast-cleaned with moving blaster units suspended from and traveling along an overhead track beam. In one embodiment, the moving blaster units are each controlled by a person in a moving operator capsule moving in tandem with a moving blaster unit. In another embodiment, the moving blaster units are robotically controlled from a robotic controller which has access to a three-dimensional plan of the barge, communicating with the robotic blaster units via RF antennae, and receiving real-time data from sensors located on each blaster head. Optionally, the system for blast-cleaning a barge can provide blaster-head cameras for real-time remote monitoring of operations and for recording of the operations allowing review of any issue, such as damage, that might arise.

10 Claims, 4 Drawing Sheets

(56) References Cited

U.S. PATENT DOCUMENTS

| | | | | |
|---|---|---|---|---|
| 8,894,467 | B2 | 11/2014 | Santure | |
| 9,522,412 | B2 * | 12/2016 | Rina | B05C 11/1018 |
| 2003/0064668 | A1 * | 4/2003 | Mrak | B24C 5/066 451/88 |
| 2005/0199171 | A1 * | 9/2005 | Ecklund | B63B 59/08 114/222 |

* cited by examiner

SYSTEM FOR BLAST-CLEANING A BARGE DECK, SIDES, AND FITTINGS

CROSS-REFERENCE TO RELATED APPLICATIONS

This application is a continuation-in-part of my co-pending application Ser. No. 15/867,862 filed on Jan. 11, 2018, the full disclosure of which is incorporated by reference herein and priority of which is hereby claimed.

BACKGROUND

This invention provides a system for blast-cleaning a barge deck, sides, and fittings providing for safety and avoidance of damage to the barge and to persons.

Barges are flat-bottomed boats used primarily for river and canal transport of heavy or bulk goods. Many barges are not self-propelled, and must be towed or pushed by towboats or other means. Many barges are long and narrow in order to provide a large amount of internal area without presenting a width that would interfere with navigation. The construction and operation of barges is subject to regulations and safety considerations. Barges, being vessels designed to float on relatively calm waters, and accordingly being supported substantially uniformly along their entire structures, are generally not able to withstand significant differential supporting or torsional forces without damage to the structure of the barge. Therefore, when on land, such as for repair, retrofitting, or maintenance, barges must be kept level and be evenly supported.

In order to place a barge upon public waterways, the barge must be designed, built, and maintained to published standards. These standards specify the location of every hatch, pipe, and valve on the deck of the barge. There are many such fittings, because the barge is compartmentalized to prevent any sloshing motion of the contents and to accommodate different types of contents. When a barge is blast-cleaned, to remove loose paint, rust, and various encrustations, such blasting must reach over, under, and around every protrusion and crevice of every fitting in order to get the barge adequately blast-cleaned, but must not knock or otherwise damage any fitting. The time of cleaning is also a time to inspect the barge and fittings for existing damage, because such damage is more easily detected on a blast-cleaned barge. However, it is difficult to distinguish between damage already existing on the barge and damage caused by the blast-cleaning process, since evidence of existing damage such as rust formation will have been cleaned away. This difficulty in attributing damage can lead to disputes with barge owners and operators.

The prior art does not provide for a system for blast-cleaning a barge deck, sides, and fittings providing for safety and avoidance of damage to the barge and to persons.

For example, U.S. Pat. No. 7,823,523 was issued on Nov. 2, 2010 to inventor Marcelo Alejandro Perez, covering a "Portable Dry Dock System and Method for Commercial Servicing of Recreational Vessels in Inland Waterways." The Portable Dry Dock ("PDD") is disassembled and transported from one inland waterway ("IW") to another. The PDD was designed specifically to improve efficiency in the most typical maintenance jobs in recreational vessels ("RVs"). The convenient layout of the equipment and the closed environment of the PDD reduce the execution time and improve the working conditions. The isolated environment created by the superstructure, deck, and roof of the PDD significantly reduces the environmental impact. The isolated environment inside the PDD is controlled in temperature and humidity. The air filtering and waste water collection systems remove dust and other substances coming from the operation, stopping pollutants from getting into the IW.

U.S. Pat. No. 7,934,467, issued to John Stephen Morton for a "Cost Effective Automated Preparation and Coating Methodology for Large Surfaces" on May 3, 2011, discloses an apparatus and method of preparing and coating a large structure, such as a ship's hull, while in a dry dock. A plurality of spray guns, disposed in an array, are positioned by a robotic arm in a spaced relationship along the surface to be treated, so that their spray patterns overlap. The array of spray guns is traversed downwardly, thus painting a strip whereupon the spray guns are secured, move horizontally, and are then activated to be moved upwardly until another strip adjacent to and overlapping the first strip is painted. The above steps are repeated until the surface area is substantially entirely painted. A shroud is provided for collecting paint oversprays, and other excess paint is mounted in the array assemblage. An auxiliary spray gun may be positioned and its spray pattern adjusted to apply paint to areas that were missed by the original spray pattern emanating from the array of spray guns. Travel of the system along the work surface is accomplished by a reference track, which may be virtual or actual, along which an unmanned platform travels. An articulated computer controlled arm is carried by the unmanned platform, which in turn carries the assemblage. Other tools may be selectively operatively connected to the arm for cleaning the hull before a coating is applied thereto.

U.S. Pat. No. 5,398,632 was issued to inventors Richard A. Goldbach et al. on Mar. 21, 1995 for an "Apparatus and Method for Performing External Surface Work on Ship Hulls." The Goldbach system covers shrouded towers for supporting adjustably cantilevered work platforms for performing external surface work on ship hulls (such as abrading and painting), modularized for the sake of economy and efficient utilization. The system provides for shifting of modules using techniques and equipment currently used for shifting shipping containers. Supply and recovery line connections between support barge-mounted equipment, floating drydock, and work platform-mounted work applicators is facilitated by fixed installation of some portions and the provision of flexible connectors between these portions. Alternative adjustable cantilevering structures are disclosed for mounting the work platforms to the vertically movable trolleys. Preferably, rotating wheels, rather than compressed air, are used to propel the abrasive grit against the hull surface, and abrasive supply systems having degrees of automated recovery of spent grit are disclosed. The system was, in part, developed to provide sufficient freedom of motion to permit full worker and/or robotic access to all of the external surface of the ship hull that is to be worked on, and also to contain abrasive blast dust, spent abrasive, paint overspray, and volatile organic compounds ("VOCs"), thereby significantly reducing the quantities of these materials that are released to contaminate the air, nearby bodies of water, ship's mechanical equipment, drydock cranes, and the like, and to significantly reduce the disruption of the concurrent shipboard repair work, all without increasing the drydock utilization times or ship out-of-service times. The Goldbach system is owned by MMC Compliance Engineering, Inc. of Norfolk, Va., as the assignee of the issued '632 Patent.

U.S. Pat. No. 5,355,823 was also created by inventors Richard A. Goldbach et al., and issued on Oct. 18, 1994 for an "Apparatus and Method for Performing External Surface Work on Ships' Hulls." This coating system, also assigned to MMC Compliance Engineering, Inc., was developed for use in coating the exterior of a ship hull while the ship is in drydock or afloat, creating a sizable chamber with comprehensive staging access for all required work. That chamber is sealed off to contain environmentally unacceptable byproducts of the coating process, and to keep storm water runoff from passing through spent abrasive and paint overspray on the deck of the drydock or barge. The system further keeps out weather conditions that could delay and deteriorate the quality of the coating process, and ventilates and evacuates the chamber, maintaining an atmosphere inside the chamber that is conducive to worker safety and high coating quality. Further, an atmosphere is maintained outside the chamber that is conductive to meeting requirements for the clean air and clean water laws and regulations, while at the same time reducing the overall cost of coating. The work platform may be configured as necessary, allowing for seats, handholds, rails, and so forth. At its most basic, it includes a support capable of supporting at least one, and preferably two, side-by-side human workers. A typical work platform is on the order of sixteen feet wide (lengthwise of the ship), and two feet deep (widthwise of the ship). Similar support for a robotics device instead of or in addition to one or more human workers is within the contemplation of the patent as well.

U.S. Pat. No. 8,894,467, issued to Robert J. Santure on Nov. 25, 2014, covers a "Surface Media Blasting System and Method." The Santure system delivers media blasting material to an interior surface of a large storage tank, comprising a substantially upright support structure secured to the surface to be blasted. The upright support structure is preferably vertical, with a frame extending across the upright support structure. An extendable arm is affixed to the frame at a section. The section is securely and pivotably attached to the section in such a way to enable the arm to rotate freely inside the large storage tank, so that the blaster secured at the end of the extendable arm can blast the entire interior surface of the large storage tank while the upright support structure remains in place. A robot blaster is positioned at the end of the extendable arm and performs the media blasting. A work station is located nearby the site of the large storage tank, and controls the position of the extendable arm relative to the interior surface being blasted via a processor and the operation of the blasting delivery system. The surfaces to be blasted may also include the exterior surface of all types of large storage tanks and structures, ship hulls, and exterior and interior building wall surfaces.

U.S. Pat. No. 5,353,729 is a third Goldbach et al. patent, issued on Oct. 11, 1994 for a third "Apparatus and Method for Performing External Surface Work on Ship Hulls." In this patent, dry, particulate abrasive for use in abrasive blast cleaning of a ship hull is supplied to blasting pots from abrasive supply hopper assemblies lifted into place from a recycling station. Spent abrasive, with debris, is collected and placed on a conveyor belt extending parallel to the keel blocks, for conveying the collected material to the recycling station. There, the collected material is processed to remove undersized and foreign material from the reuseable abrasive grit. The latter is loaded into supply hopper assemblies, which are crane-lifted back into supplying relation with respective blasting pots. Preferably, the abrasive blasting work takes place from elevatable, curtain-enclosed platforms supported on a drydock floor, the blasting pots are located on the drydock wing wall, the abrasive grit is ferromagnetic and recovered from the drydock floor partly with the aid of a magnetic abrasive pick-up unit, and the recycling station is located on a barge moored at an end of the drydock.

U.S. Pat. No. 5,211,125 was issued on May 18, 1993 to inventors Charles Garland et al., covering an "Apparatus and Method for Performing External Surface Work on Ships' Hulls." The system provides for cleaning and/or painting of the exterior of a ship hull while the ship is in dry dock, with one or more staging devices provided. Each such staging device includes a metal framework tower supporting a vertically movable elevator assembly that comprises a trolley, from which a variably laterally projected platform is supported on articulated, cantilevered arms. Adjustable, non-porous shrouds enclose a volume of space between the outside of the tower and an increment of one side of the exterior of the ship hull, from above, fore, aft, and outside. Cleaning and painting operations are conducted from the platform on the hull increment, and debris is removed from the dry-dock deck area enclosed by the shroud, after which the device is moved by crane, typically on the order of approximately twenty feet, towards the ship's bow or stern. The shrouds are then adjusted so that a further hull increment can be worked on at that point. The trolley and extension-retraction of the platform support arms are operated by electrohydraulic winch and hydraulic cylinders, respectively. The margins of the shroud may be fastened by magnets to the hull, and air drawn through the enclosed volume from above is drawn out near the dry-dock deck for processing to remove dust and appropriately treat VOCs, if such VOCs are present. The '125 Patent is jointly owned by Metro Machine Corporation and Tidewater Equipment Corporation of Norfolk, Va. and Chesapeake, Va., respectively, as the dual assignees of record.

U.S. Pat. No. 5,085,161, also owned by Metro Machine Corporation, as well as Marinex International, Inc. of Hoboken, N.J., was issued on Feb. 4, 1992 for a "Vessel Hull and Construction Method." The system, developed by inventors Joseph Cuneo, Charles Garland, and Richard A. Goldbach et al., provides for a parallel midbody of a hull of a tanker fabricated of modules, each made of double-walled longitudinal subassemblies welded to one another and to a bulkhead. The subassemblies are made of outer cylindrically curved plates welded edge to edge, and inner cylindrically curved plates welded edge to edge. Longitudinal rib plates are extended between and are welded into joints between curved plates in the inner and outer hulls. The curved plates are convex towards the exterior of the vessel. At respective transitions between the bottom and sides, the inner and outer hulls have bilge radii that approximate in size the radii of curvature of others of the plates, including ones both adjacent to and remote from the bottom-to-side transitions. A fixture for facilitating welding of the T-joints of the subassemblies is also provided, where the subassemblies and modules are fabricated in an up-ended orientation. Each successively completed module is tilted-over and joined to the growing midbody with the aid of a variable buoyancy barge and a caisson pontoon. More specifically, in the room of the system, stationary or fixed elevator towers equipped with shot-blasting and spray-painting nozzles are located in positions in the building, which center them in individual longitudinal cells of the longitudinal subassembly. These elevators are used for automatic shot-blasting and painting of inside surface of the longitudinal subassemblies. Further, elevators are permanently located along the walls of the building to permit automatic shot blasting and painting of outside surfaces of longitudinal subassemblies. Shot-blasting nozzles inside and outside the cells are located only in way of welded T-joints. Paint spray nozzles inside and outside the cubicles provide full surface coverage. Dust collection equipment is provided to remove dust caused by shot blasting, and heating, ventilation, and dehumidification equipment is provided to control the environment and assure that release of solvents and dust to the atmosphere externally of the building is within clean air standards. All electrical installations are explosion-proof.

U.S. Pat. No. 6,102,157, created by inventors Richard A. Goldbach, James A. McMichael, and Charles A. Garland, was issued on Aug. 15, 2000 for a "Self-Contained Staging System for Cleaning and Painting Bulk Cargo Holds." In the system, each of a plurality of cargo holds of a bulk carrier vessel has a self-contained staging system lowered into it, from the platform track of which workers operate semi-automatic blasting machines that are mounted onto the platform. The set-up for each vessel also includes, for each hold, a ventilation unit provided on a hatch plug, and a transporter for the staging system. Groups of staging systems are served by on-deck air compressors, and staging systems actually engaging in blasting are served by recycling shot blast units that recycle and supply steel shot. Following blast cleaning, the cleaned surfaces are painted from the platforms. The '157 Patent is owned by Metro Machine Corporation of Norfolk, Va., as the assignee of record to the patent file.

Lastly, European Patent Appl. No. 0,165,911 was published on Dec. 19, 1990 by Rosario Scuderi et al., disclosing a "Method and Robot Platform for Washing, Sandblasting, and Painting in Shipbuilding Dry Dock." The system was developed in part to provide a universal structure for the three different types of treatments necessary before painting a respective surface (namely, washing, sandblasting, and painting). The system provides a robot platform for washing, sandblasting, and painting in shipbuilding dry dock, of the type insertable into the side structures provided with guide rails of a shipbuilding dock or dry dock, with at least one support translation structure with sliding trolley horizontally controlled on the guide rails of the dock sides. The trolley structure supports a swinging and/or variable-length arm, with a platform mounted at the end in a manner so as to stay always oriented in a predetermined direction, independently of the movements thereof. The platform itself comprises (a) a washing unit with washing nozzles, (b) a sandblasting unit with sandblasting guns provided with dust recovery means, and (c) a painting unit on the trolley means that moves in a reciprocating way at one side of the platform, provided with spray guns orthogonally displaced.

What is needed is a system for blast-cleaning a barge which does not generate the problems discussed above.

SUMMARY OF THE INVENTION

This invention provides a system for blast-cleaning a barge deck, sides, and fittings providing for safety and avoidance of damage to the barge and to persons, where a barge is blast-cleaned with moving blaster units suspended from and traveling along an overhead track beam.

In one embodiment, the moving blaster units are each controlled by a person in a moving operator capsule moving in tandem with a moving blaster unit. This embodiment requires that the work building be well-ventilated, and that the used blast media and removed particles be heavily filtered, in order to allow personnel to work in the building.

In another embodiment, the moving blaster units are robotically controlled from a robotic controller which has access to a three-dimensional plan of the barge, communicating with the robotic blaster units via RF antennae, and receiving real-time data from sensors located on each blaster head. This robotic embodiment does not require personnel to be inside the work building, and therefore does not require ventilation and air filtering.

Optionally, the system for blast-cleaning a barge can provide blaster-head cameras for real-time remote monitoring of operations and for recording of the operations allowing review of any issue, such as damage, that might arise.

BRIEF DESCRIPTION OF DRAWINGS

Reference will now be made to the drawings, wherein like parts are designated by like numerals, and wherein.

DETAILED DESCRIPTION OF THE INVENTION

Referring to all of the figures generally, the system for blast-cleaning a barge deck, sides, and fittings 10, 20 of the invention is shown. A first embodiment 10 of the system provides for control by human operators within eyesight of the blaster heads. A second embodiment 20 of the system provides for robotic control of the blaster heads.

Figure 1:
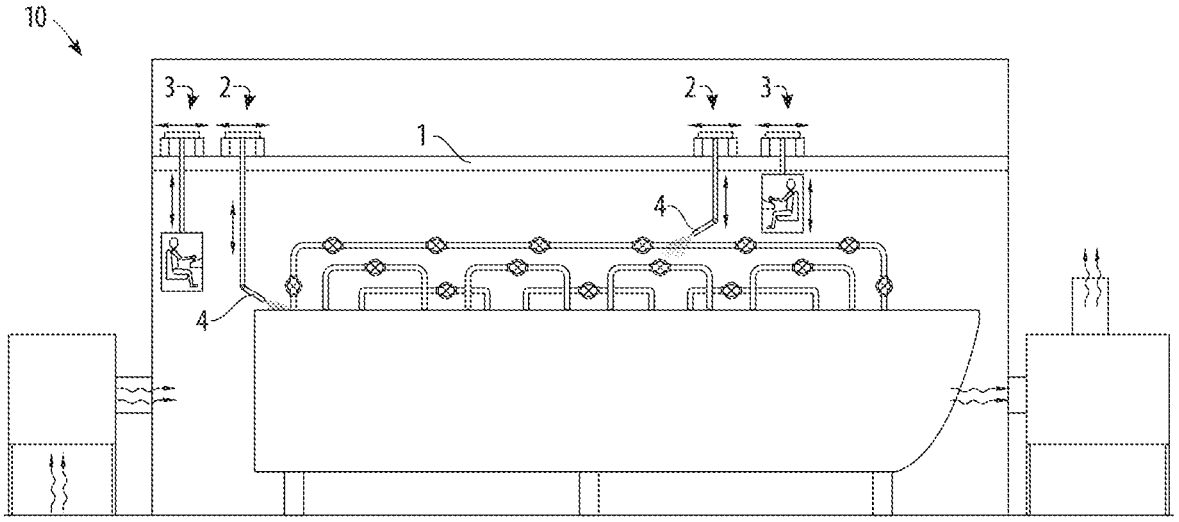
FIG. 1 is a side schematic view of the operation of a first embodiment of the system for blast-cleaning a barge deck, sides, and fittings of the invention.
Figure 3:
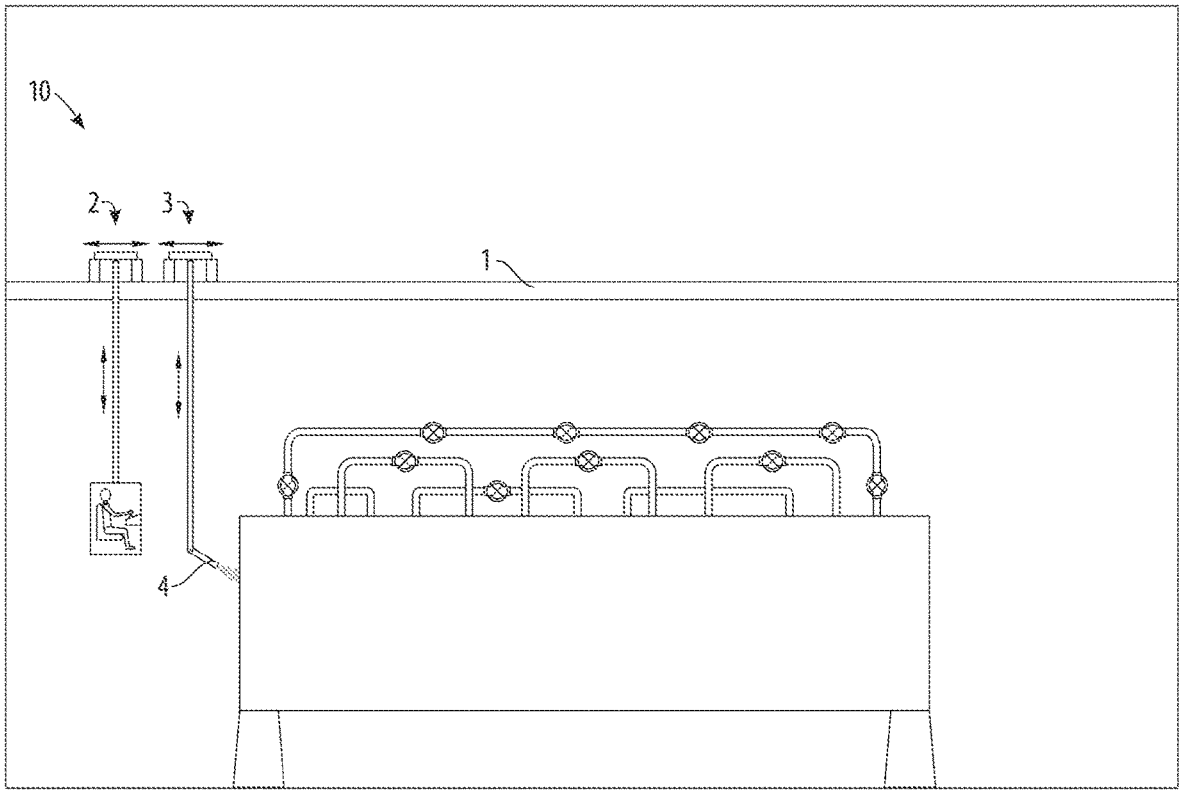
FIG. 3 is a front schematic view of the operation of a first embodiment of the system for blast-cleaning a barge deck, sides, and fittings of the invention.

Referring to FIG. 1 and FIG. 3, in a first embodiment 10 of the system for blast-cleaning a barge deck, sides, and fittings, a barge is blast-cleaned with moving blaster units 2 suspended from and traveling along an overhead track beam 1. Each moving blaster unit is controlled by a person in a moving operator capsule 3 moving in tandem with a moving blaster unit 2. The operator is able to see the position and operation of the blaster head 4 of the moving blaster unit 2. This embodiment requires that the work building be well-ventilated, and that the used blast media and removed particles be heavily filtered, in order to allow personnel to work in the building, and to allow the operators to see the blasting operation.

Figure 2:
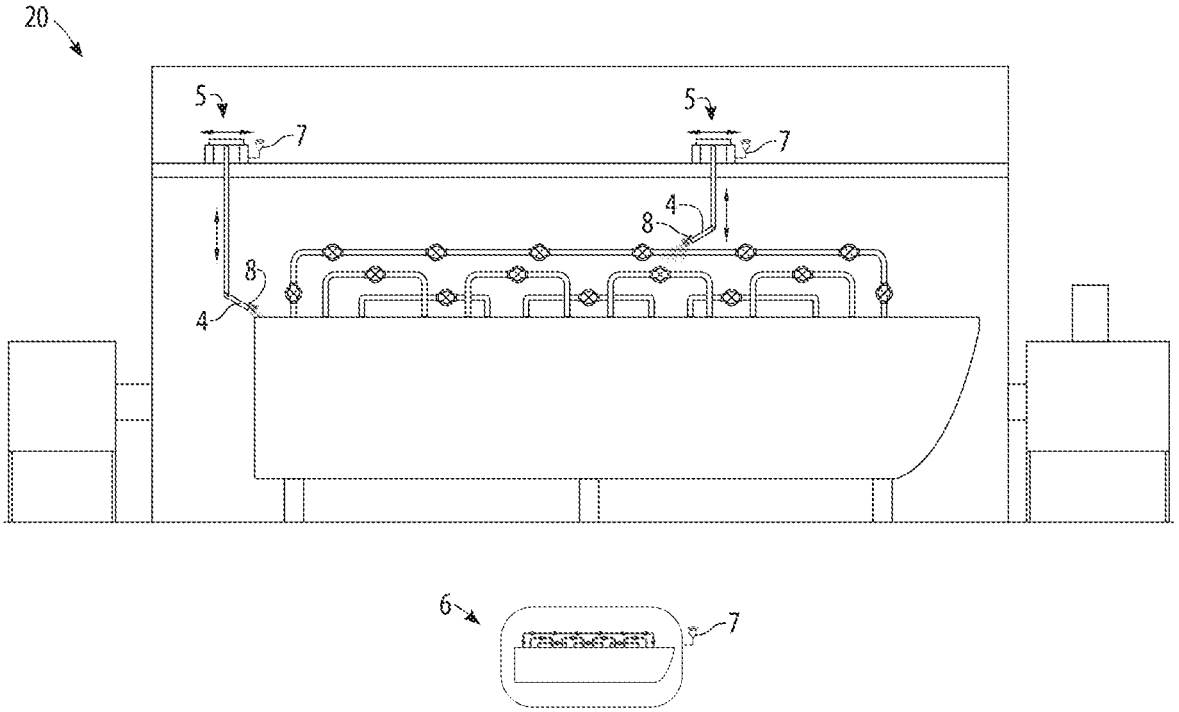
FIG. 2 is a side schematic view of the operation of a second embodiment of the system for blast-cleaning a barge deck, sides, and fittings of the invention.
Figure 4:
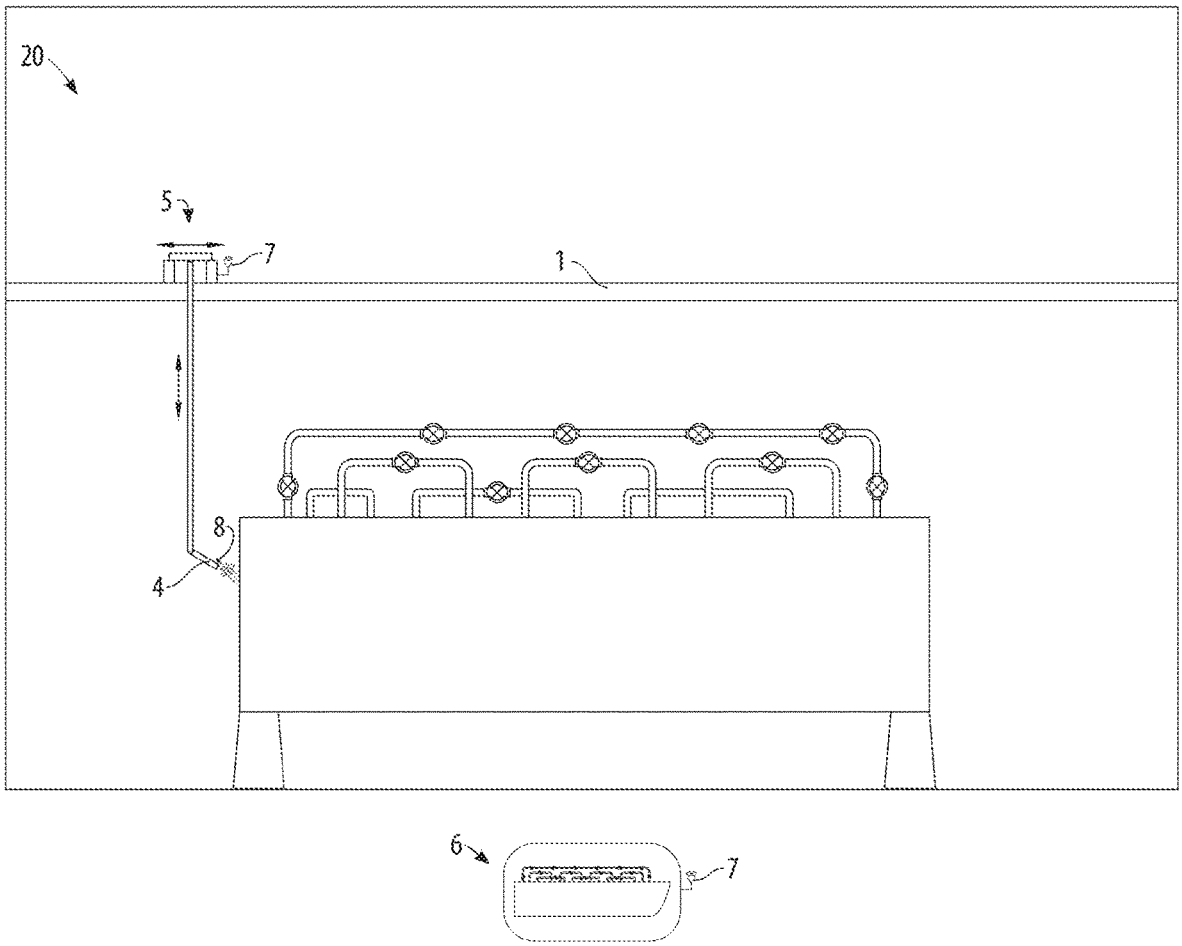
FIG. 4 is a front schematic view of the operation of a second embodiment of the system for blast-cleaning a barge deck, sides, and fittings of the invention.

Referring to FIG. 2 and FIG. 4, in a second embodiment 20 of the system for blast-cleaning a barge deck, sides, and fittings, robotically controlled robotic blaster units 5 are used, each having a blaster head 4 like the moving blaster units 2 of the first embodiment. This robotic embodiment does not require personnel to be inside the work building, and therefore does not require ventilation and air filtering.

Each blaster head 4 is provided with a blaster-head sensor 8 which can sense both the absolute position of the blaster head 4 within the whole work building, and can also sense proximate objects such as the structure or the fittings of the barge. Calculations based on these data can generate a three-dimensional model of the barge and its fittings. The sensors can be a combination of sensor types known in that art, such LIDAR (laser), ultrasonic, microwave, ultraviolet, visible, or infrared light, all based upon detecting signals emitted by or reflecting off of objects, and accelerometers, tilt sensors, and position finders based on fixed reference beacons inside the work building, from which the position, attitude, and movement of the blaster head 4 can be determined, tracked, and recorded. Optimally, the sensors will be able to function in spite of blast media being emitted by the blast head 4 and reflecting or falling off of the blasted object. The blaster-head sensor 8 should be mounted upon or within the blaster head 4 in such a way that obstruction by blast media is minimized. In circumstances where the blast media is obstructing the blaster-head sensor 8 the blasting can be performed in a sequence of pulses or bursts, between which the sensors can operate in compatibly timed pulses.

The blasting operations are robotically controlled from a robotic controller 6, which has access to the three-dimensional plan of the barge. The three-dimensional plan of the barge will almost always be available as part of the published standards to which barges must be built. If such an existing three-dimensional plan is not available, a plan can be generated by making a dry run of the operations and capturing the sensor data. Communication between the robotic blaster units 5 and the robotic controller 6 can be accomplished via RF antennae 7, using a type and frequency of signals which are not blocked by blast media suspended in the air. Careful antenna placement can avoid signals being blocked by the barge itself.

In use, the robotic controller 6 receives real-time data from sensors located on each blaster head. This data stream can be recorded, creating a very detailed record of the blasting operation which can be referred to should any question or dispute about the operation be raised. If the robotic controller 6 is working from a standard three-dimensional plan of a barge, then the real-time data from the blaster-head sensors can be checked against the standard plan, and any deviation from the plan can be detected and flagged. Optionally, any such deviation might trigger an automatic pausing of the blasting operations, at least for that blaster head, until the deviation can be inspected. The robotic controller 6 should prevent the blaster head 4 from making contact with any object detected by the blaster-head sensor 8 except under an explicit override.

Figure 5:
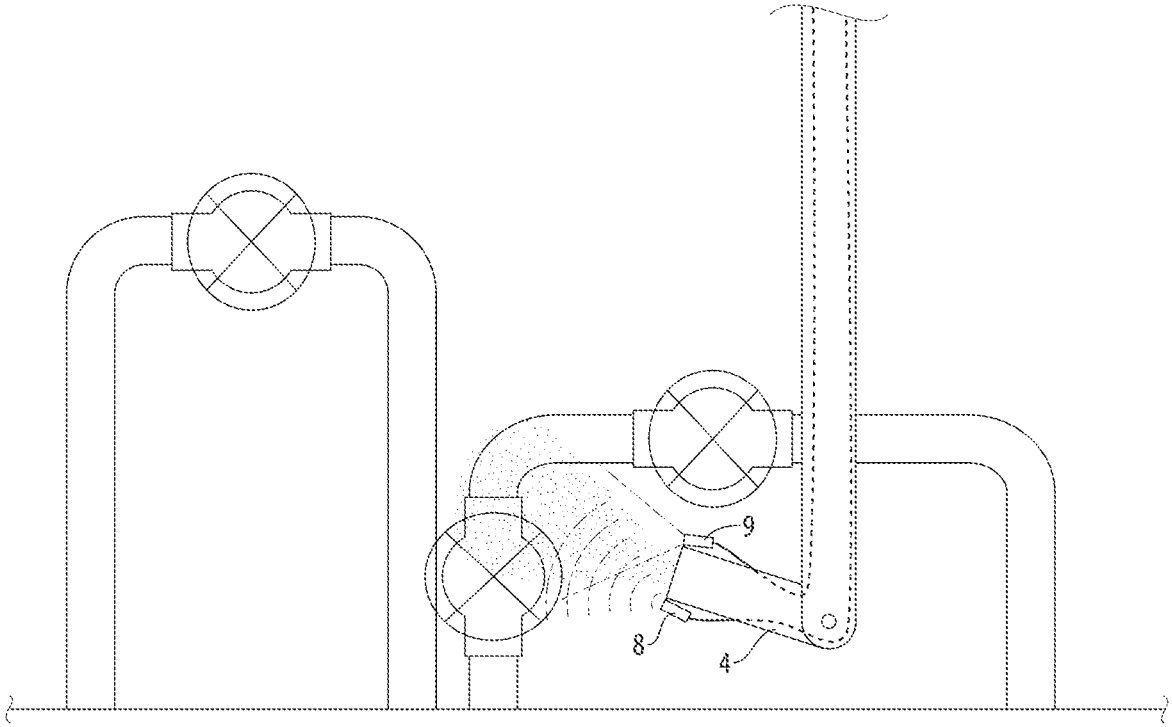
FIG. 5 is a detail schematic view of the blaster head of the system for blast-cleaning a barge deck, sides, and fittings of the invention.

Referring to FIG. 5, in use, the blaster head 4 of the system for blast-cleaning a barge deck, sides, and fittings can reach and blast the undersides of the pipes, valves, hatches, and other fittings on the deck of the barge, by being positioned below the fittings and expelling blast media upward.

Optionally, the system for blast-cleaning a barge can provide blaster-head cameras 9 for real-time remote monitoring of operations and for recording of the operations. The blaster-head cameras 9 are mounted upon or within the blaster head 4 such that exposure to bouncing blast media is minimized or prevented. As with the blaster-head sensors 8, a pulsed operation of the blasting may be used to allow the taking of clear photos or video during the non-blasting periods.

Real-time video from such a blaster-head camera 9 could optionally be used as an additional sensor to be analyzed in real time by the robotic controller 6. Recorded photos or video of the blasting operation can be referred to should any question or dispute about the operation be raised.

Many other changes and modifications can be made in the system and method of the present invention without departing from the spirit thereof. I therefore pray that my rights to the present invention be limited only by the scope of the appended claims.

I claim:

1. A system for blast-cleaning a barge deck, sides, and fittings, in a work building, robotically, the system for blast-cleaning a barge deck, sides, and fittings comprising:

(i) at least one overhead track beam inside the work building above the barge and fittings;

(ii) at least one robotic blaster unit adapted to move along said overhead track beam, and having a blaster head adapted to move with said moving blaster unit and move relative to said moving blaster unit;

(iii) a blaster-head sensor mounted upon each said blaster head, adapted to sense the absolute location and attitude of said blaster head, and sense objects in proximity to said blaster head;

(iv) a robotic controller adapted to receive, interpret, and record data from said blaster-head sensor and control the operation of said robotic blaster unit with reference to a stored three-dimensional plan of the barge and fittings;

(v) an RF antenna mounted upon said robotic controller and each said robotic blaster unit, adapted to facilitate real-time communications;

where, in use, said robotic blaster unit with said blaster head is moved along said overhead track, and said blaster head is moved in relation to said moving blaster unit, under the control of the robotic controller using real-time data from said blaster-head sensor with reference to the three-dimensional plan, such that all surfaces of the barge deck, sides, and fittings are reached with blast media.

2. The system for blast-cleaning a barge deck, sides, and fittings of claim 1, further comprising a blaster-head camera.

3. The system for blast-cleaning a barge deck, sides, and fittings of claim 1, where said blaster-head sensor is further adapted to sense objects through a cloud of blast media.

4. The system for blast-cleaning a barge deck, sides, and fittings of claim 1, where said blaster-head sensor is further adapted to make sensor readings during pauses between pulses of blasting.

5. The system for blast-cleaning a barge deck, sides, and fittings of claim 1, further comprising a blaster-head sensor adapted to determine absolute location from fixed reference beacons placed inside the work building.

6. The system for blast-cleaning a barge deck, sides, and fittings of claim 1, further comprising a blaster-head camera, where video from said blaster-head camera is recorded and is combined with recorded data from said blaster-head sensor to provide for a detailed inspection of all surfaces and fittings of the barge before, during, and after blasting.

7. The system for blast-cleaning a barge deck, sides, and fittings of claim 1, further comprising a blaster-head camera, where video from said blaster-head camera is recorded for later use in analyzing and investigating blasting operations.

8. The system for blast-cleaning a barge deck, sides, and fittings of claim 1, where the three-dimensional plan of the barge is obtained from an existing outside source.

9. The system for blast-cleaning a barge deck, sides, and fittings of claim 1, where the three-dimensional plan of the barge is generated from the data obtained by said blaster-head sensors.

10. The system for blast-cleaning a barge deck, sides, and fittings of claim 1, where said robotic controller prevents said blaster head from making contact with any object sensed by the sensors.

* * * * *